US009725925B1

(12) United States Patent
Shen

(10) Patent No.: US 9,725,925 B1
(45) Date of Patent: Aug. 8, 2017

(54) DOOR LOCK USING A POWER SUPPLY OF A MOBILE DEVICE AS A POWER SOURCE

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 15/414,691

(22) Filed: Jan. 25, 2017

(51) Int. Cl.

| | |
|---|---|
| ***H01H 19/64*** | (2006.01) |
| ***E05B 47/00*** | (2006.01) |
| ***E05B 17/00*** | (2006.01) |
| ***E05B 49/00*** | (2006.01) |

(52) U.S. Cl.
CPC ..... *E05B 47/0001* (2013.01); *E05B 17/00* (2013.01); *E05B 49/00* (2013.01); *E05B 2047/0058* (2013.01); *E05B 2047/0097* (2013.01)

(58) Field of Classification Search
CPC ..... E05B 47/0001; E05B 17/00; E05B 49/00; E05B 2047/0097
See application file for complete search history.

(56) References Cited

U.S. PATENT DOCUMENTS

2017/0002586 A1* 1/2017 Lee ..... E05B 47/0012

* cited by examiner

*Primary Examiner* — Daniel Cavallari
(74) *Attorney, Agent, or Firm* — Alan D. Kamrath; Kamrath IP Lawfirm, P.A.

(57) ABSTRACT

A door lock includes a latch device and inner and outer operating devices operatively connected to the latch device. The inner operating device includes a control module and a first battery module electrically connected to the control module and supplying electricity for operation of the door lock. A detecting module is electrically connected between the first battery module and the control module. The outer operating device includes a first electric connecting device electrically connected to the detecting module and an unlocking information input module electrically connected to the control module. When the remaining electricity of the first battery module detected by the detecting module is lower than a preset alarm value and a second electric connecting device of a mobile device is in electrical connection with the first electric connecting device, the second battery module of the mobile device supplies electricity to the door lock for operation.

6 Claims, 6 Drawing Sheets

DOOR LOCK USING A POWER SUPPLY OF A MOBILE DEVICE AS A POWER SOURCE

BACKGROUND OF THE INVENTION

The present invention relates to a door lock using a power supply of a mobile device as a power source and, more particularly, to a door lock that can be set to a locked state or an unlocked state by use of electricity.

With the development of technology, conventional mechanical door locks operated through manual operation are gradually replaced by electric door locks that are operated through use of electricity or through use of electricity and manual operation. An electric door lock of this type can be unlocked by an unlocking procedure after inputting a pin number through a keypad, picking up a biological feature, or reception of an encryption key. After identifying the received pin number, biological feature, or encryption key, the electric door lock decides whether to proceed with the unlocking procedure. Furthermore, a driving device, such as a motor or electromagnetic valve, is used to actuate an internal mechanism of the electric door lock to set the electric door lock to a locked state or an unlocked state.

Operation of the above electric door lock requires electricity. Currently, there are two types of power sources of electricity including power supply terminals in a building and batteries installed in the electric door lock. The electric door locks using power sources of the first type cannot be operated when power outage occurs and are troublesome in installation. The electric door locks using power sources of the second type cannot be operated when the batteries run out of electricity.

BRIEF SUMMARY OF THE INVENTION

To avoid the disadvantages encountered in the conventional electric door locks, the present invention provides a door lock using a power supply of a mobile device as the power source.

In a first aspect, a door lock uses a power supply of a mobile device as a power source and is configured to prevent opening of a door in a closed position. The door lock includes a latch device operable to be set to a locked state or an unlocked state. An inner operating device is operatively connected to the latch device. The inner operating device includes a control module and a first battery module electrically connected to the control module and supplying electricity for operation of the door lock. The inner operating device further includes a detecting module electrically connected between the first battery module and the control module. The detecting module detects whether the remaining electricity of the first battery module is higher or lower than a preset alarm value. An outer operating device is operatively connected to the latch device. The outer operating device includes a first electric connecting device electrically connected to the detecting module and an unlocking information input module electrically connected to the control module. The first electric connecting device is configured to be in electrical connection with a second electric connecting device of a mobile device having a screen.

When the latch device is set to the unlocked state, either of the inner operating device and the outer operating device is operable to actuate the latch device for opening the door. When the latch device is set to the locked state, operation of the outer operating device for actuating the latch device for opening the door is prevented. When the remaining electricity of the first battery module detected by the detecting module is higher than the preset alarm value, the first battery module supplies electricity to the door lock for operation. When the remaining electricity of the first battery module detected by the detecting module is lower than the preset alarm value and the second electric connecting device of the mobile device is in electrical connection with the first electric connecting device, the second battery module of the mobile device supplies electricity to the door lock for operation.

In an example, the outer operating device further includes a reminding device electrically connected to the control module. When the remaining electricity of the first battery module detected by the detecting module is higher than the preset alarm value, the reminding device is not activated by the control module. When the remaining electricity of the first battery module detected by the detecting module is lower than the preset alarm value, the reminding device is activated by the control module to generate a reminding signal indicating that the remaining electricity is lower than the preset alarm value. The reminding device is a buzzer or a lighting device.

In a second example, a door lock uses a power supply of a mobile device as a power source and is configured to prevent opening of a door in a closed position. The door lock includes a latch device operable to be set to a locked state or an unlocked state. An inner operating device is operatively connected to the latch device. The inner operating device includes a control module and a first battery module electrically connected to the control module and supplying electricity for operation of the door lock. The inner operating device further includes a charging module electrically connected to the first battery module. An outer operating device is operatively connected to the latch device. The outer operating device includes a first electric connecting device electrically connected to the charging module and an unlocking information input module electrically connected to the control module. The first electric connecting device is configured to be in electrical connection with a second electric connecting device of a mobile device having a screen.

When the latch device is set to the unlocked state, either of the inner operating device and the outer operating device is operable to actuate the latch device for opening the door. When the latch device is set to the locked state, operation of the outer operating device for actuating the latch device for opening the door is prevented. When the second electric connecting device of the mobile device is not in electrical connection with the first electric connecting device, the second battery module does not charge the first battery module. When the second electric connecting device of the mobile device is in electrical connection with the first electric connecting device, the second battery module charges the first battery module through the charging module.

In an example, the inner operating device further includes a detecting module electrically connected between the first battery module and the control module. The detecting module detecting whether the remaining electricity of the first battery module is higher or lower than a preset alarm value. The outer operating device further includes a reminding device electrically connected to the control module. When the remaining electricity of the first battery module detected by the detecting module is higher than the preset alarm value, the reminding device is not activated by the control module. When the remaining electricity of the first battery module detected by the detecting module is lower than the preset alarm value, the reminding device is activated by the control module to generate a reminding signal indicating that the remaining electricity is lower than the preset alarm value. The reminding device is a buzzer or a lighting device.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
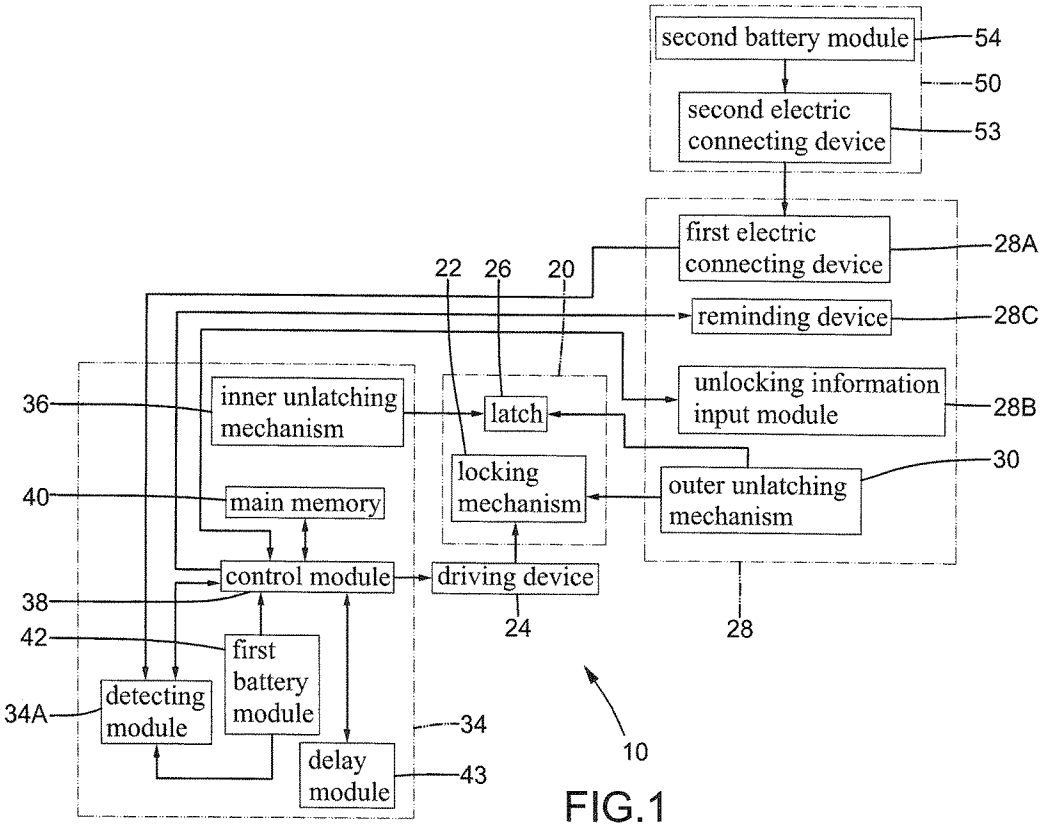
FIG. 1 is a diagrammatic block diagram illustrating a door lock using a power supply of a mobile device as the power source of a first embodiment according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "inner", "outer", "face", "side", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 2:
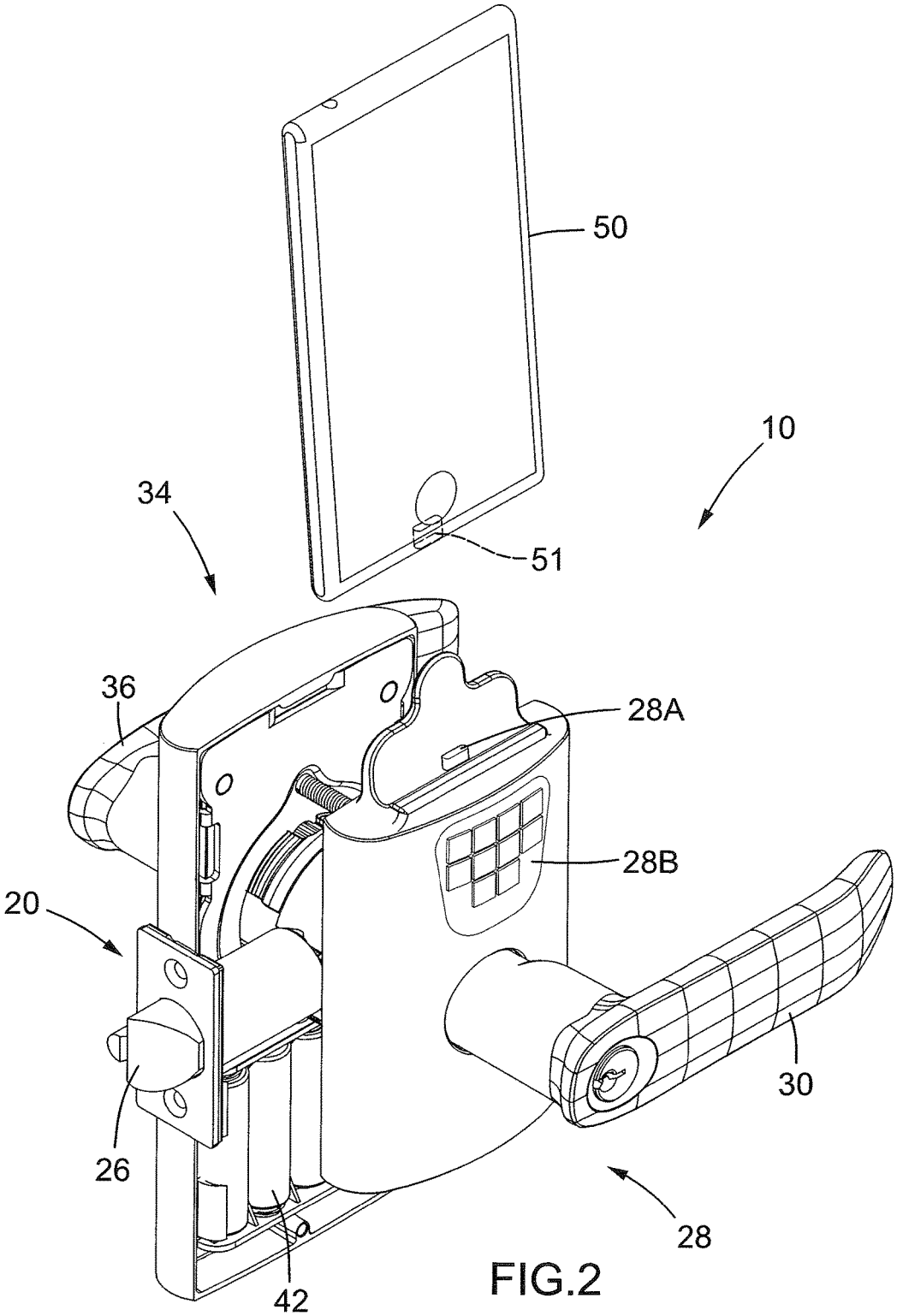
FIG. 2 is a diagrammatic perspective view illustrating use of the door lock and the mobile device of the first embodiment.

FIGS. 1 and 2 show a door lock 10 using a power supply of a mobile device as the power source of a first embodiment according to the present invention. Door lock 10 includes a latch device 20 adapted to be mounted to a door. Latch device 20 includes a locking mechanism 22 and a latch 26 operable to move between a latching position outside of an end face of the door and an unlatching position retracted into the end face of door. Latch device 20 is preset to a locked state by locking mechanism 22 and is operatively connected to a driving device 24 driven by electricity. Driving device 24 is operatively connected to locking mechanism 22 to permit latch device 20 to be set to an unlocked state. Driving device 24 can be a motor, an electromagnetic valve, etc.

Door lock 10 further includes an inner operating device 34 mounted to an inner face of the door and an outer operating device 28 mounted to an outer face of the door. Outer operating device 28 includes an outer unlatching mechanism 30 operatively connected to latch 26 and locking mechanism 22. Outer operating device 28 further includes a first electric connecting device 28A, a reminding device 28C, and an unlocking information input module 28B. Outer unlatching mechanism 30 can be an outer handle and components jointly moveable with the outer handle. First electric connecting device 28A can be a universal serial bus (USB). With reference to FIG. 2, unlocking information input module 28B of the first embodiment is a keypad (including buttons bearing digits) mounted to an outer side of outer operating device 28. A pin number can be inputted through the keypad for unlocking door lock 10. Reminding device 28C can be a buzzer, a lighting device, etc.

Latch device 20 is normally set to the locked state by locking mechanism 22 cooperating with outer unlatching mechanism 30. Specifically, when latch device 20 in the locked state, latch 26 cannot be moved from the latching position to the unlatching position by operating outer unlatching mechanism 30 of outer operating device 28. Locking mechanism 22 can be a mechanism preventing pivotal movement of the outer handle of outer unlatching mechanism 30. Thus, when latch device 20 is set to the locked state, the outer handle of outer unlatching mechanism 30 is locked by locking mechanism 22. On the other hand, when latch device 20 is set to the unlocked state, locking mechanism 22 releases the outer handle of outer unlatching mechanism 30.

Inner operating device 34 includes an inner unlatching mechanism 36 operatively connected to latch 26. Inner operating device 34 further includes a control module 38, a main memory 40, and a delay module 43. Main memory 40 and delay module 43 are electrically connected to control module 38. Inner operating device 34 further includes a detecting module 34A electrically connected between control module 38 and first battery module 42. First electric connecting device 28A is electrically connected to detecting module 34A. Control module 38 is electrically connected to first electric connecting device 28A, unlocking information input module 28B, and reminding device 28C. Main memory 40 can store a set of authenticated pin numbers. Delay module 43 is used to set a delay time, which can be 5-30 seconds, preferably 10 seconds. When latch device 20 is set to the locked state, delay module 43 starts to count down the set delay time.

Detecting module 34A detects whether the remaining electricity of first battery module 42 is higher or lower than a preset alarm value. First battery module 42 provides electricity for operation of outer operating device 28, inner operating device 34, and driving device 24. The preset alarm value is preferably set in a mode that the remaining electricity of first battery module 42 is still sufficient for operation of outer operating device 28, inner operating device 34, and driving device 24.

The first embodiment shown in FIGS. 1 and 2 further includes a mobile device 50 having a screen. Mobile device 50 includes a second battery module 54 and a second electric connecting device 53 electrically connected to second battery module 54. Second electric connecting device 53 can be a universal serial bus (USB) detachably and electrically connected to first electric connecting device 28A. Mobile device 50 can be a smart phone, a tablet computer, a personal digital assistant (PDA), or a notebook computer.

For the sake of explanation, it will be assumed that latch device 20 of door lock 10 is preset to the locked state. The remaining electricity of first battery module 42 detected by detecting module 34A is higher than the preset alarm value, such that first battery module 42 provides sufficient electricity for operation of outer operating device 28, inner operating device 34, and driving device 24. Furthermore, control module 38 does not activate reminding device 28C.

When latch device 20 is set to the locked state, latch 26 cannot be moved from the latching position to the unlatching position by operating outer unlatching mechanism 30 of outer operating device 28. As a result, entry from outside into inside of the door is prohibited. However, inner unlatching mechanism 36 of inner operating device 34 can be operated to move latch 26 from the latching position to the unlatching position. Thus, even though latch device 20 is in the locked state, passage from inside to outside of the door is permitted.

When it is desired to move from outside to inside of the door, a pin number is inputted through unlocking information input module 28B in the form of a keypad in the first embodiment. If control module 28 identifies that the pin number matches one of the set of authenticated pin numbers in main memory 40, control module 38 outputs an unlocking signal to driving device 24 which drives locking mechanism 22 to thereby temporarily set latch device 20 to the unlocked state. Thus, outer unlatching mechanism 30 of outer operating device 28 can be operated to move latch 26 from the latching position to the unlatching position to thereby permit subsequent opening of the door. After latch 26 is moved by outer unlatching mechanism 30 to the unlatching position and the door is closed again, control module 38 outputs a locking signal to driving device 24 which drives locking mechanism 22 to set latching device 20 to the locked state, such that outer unlatching mechanism 30 of outer operating device 28 cannot move latch 26 from the latching position to the unlatching position.

When latch device 20 is set to the unlocked state, no matter outer unlatching mechanism 30 of outer operating device 28 is operated to move latch 26 from the latching position to the unlatching position, delay module 43 starts to count down the delay time. Latch device 20 remains in the unlocked state during the countdown. After the countdown, control module 38 outputs a locking signal to driving device 24 which operates locking mechanism 22 to set latch device 20 to the locked state. Thus, even if latch 26 is not moved from the latching position to the unlatching position, latch device 20 will be set to the locked state after the countdown of the delay time.

When it is desired to open the door from the inside, since operation of inner unlatching mechanism 36 is not limited by locking mechanism 22, no matter latch device 20 is et to the locked state or unlocked state, inner unlatching mechanism 36 can be operated from inside of the door to move latch 26 from the latching position to the unlatching position to thereby open the door.

In a case that detecting module 34A detects that the remaining electricity of first battery module 42 is lower than the preset alarm value, control module 38 activates reminding device 28C to generate a reminding signal indicating that the remaining electricity is lower than the preset alarm value. In an example that reminding device 28C is a buzzer, reminding device 28C generates sounds as the reminding signal. In another case that reminding device 28C is a lighting device, reminding device 28C generates light (such as flickering red light) as the reminding signal. Thus, although first battery module 42 can still provide electricity to inner operating device 34, outer operating device 28, and driving device 24 for operation, a user can electrically connect second electric connecting device 53 (such as a micro USB slot) of mobile device 50 (such as a smart phone) with first electric connecting device 28A of outer operating device 28, such that second battery module 54 of mobile device 50 can provide electricity to inner operating device 34, outer operating device 28, and driving device 24. As a result, inner operating device 34, outer operating device 28, and driving device 24 can operate without using first battery module 42. Consequently, door lock 12 can still operate.

It is noted that even if first battery module 42 is completely out of electricity while second electric connecting device 53 of mobile device 50 is in electrical connection with first electric connecting device 28A of outer operating device 28, second battery module 54 of mobile device 50 can provides electricity to inner operating device 34, outer operating device 28, and driving device 24. Consequently, door lock 12 can still operate normally and temporarily when first battery module 42 is out of electricity.

Figure 3:
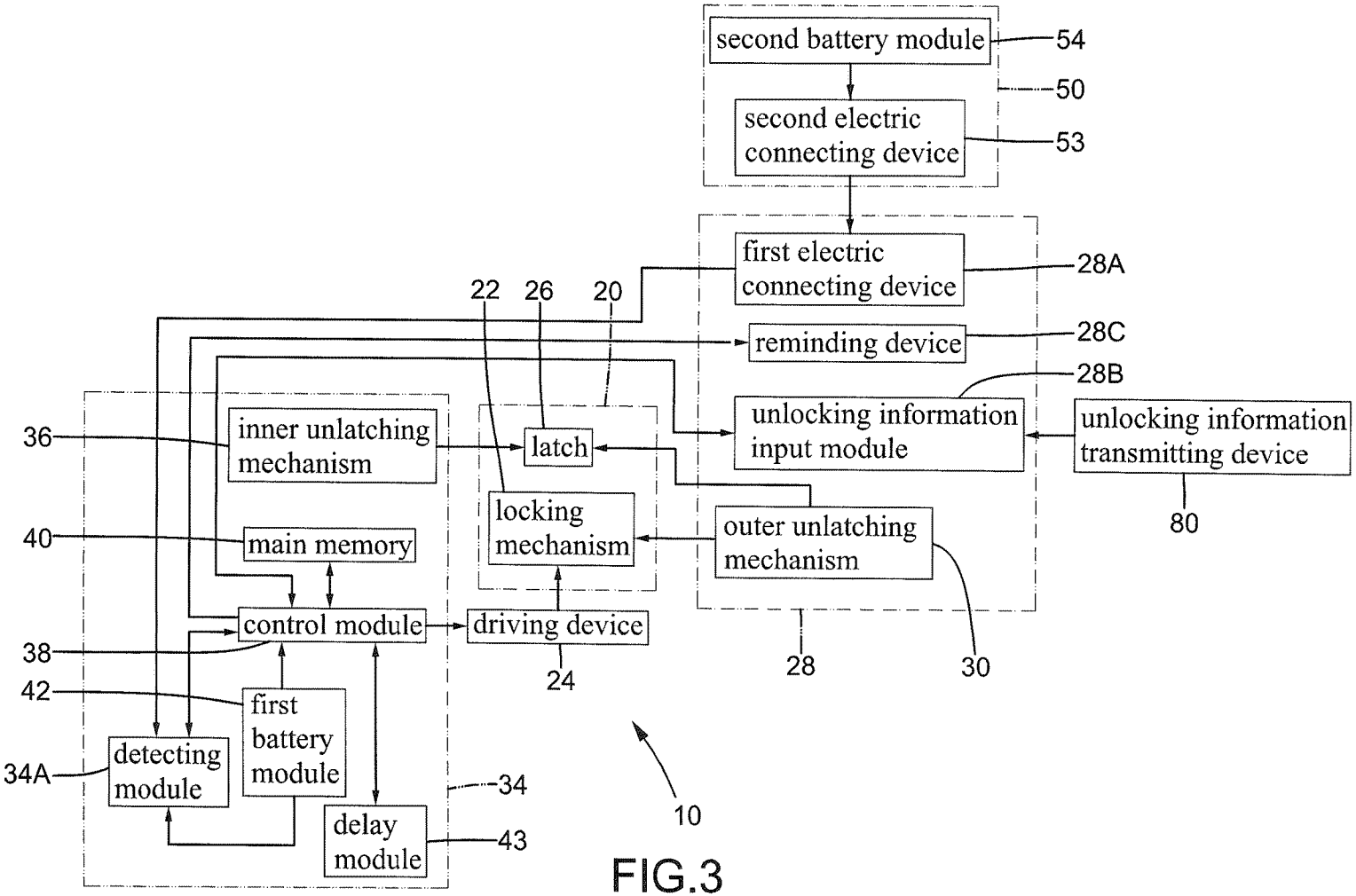
FIG. 3 is a diagrammatic block diagram illustrating a door lock using a power supply of a mobile device as the power source of a second embodiment according to the present invention.
Figure 4:
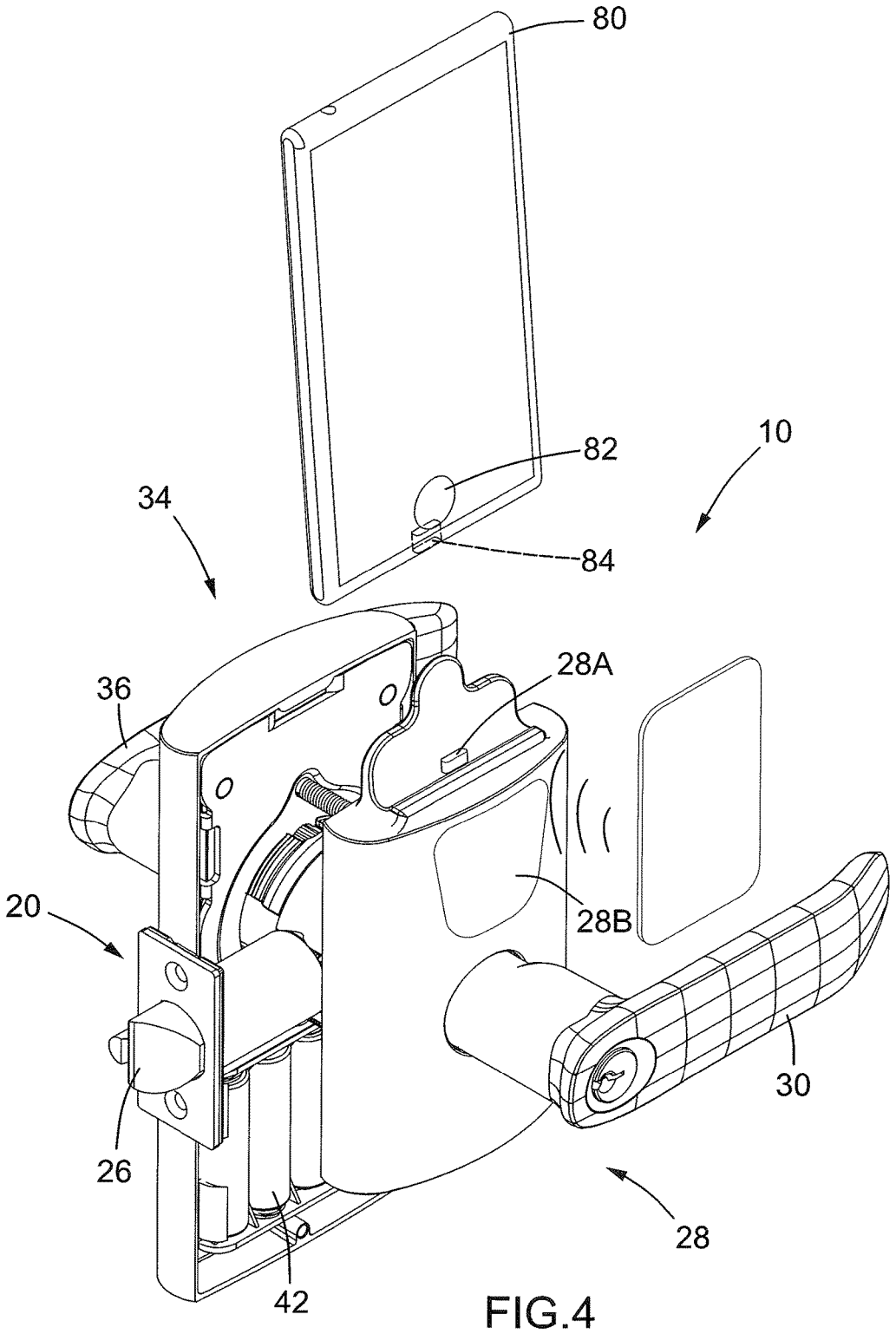
FIG. 4 is a diagrammatic perspective view illustrating use of the door lock and the mobile device of the second embodiment.

FIGS. 3 and 4 show a second embodiment which is substantially the same as the first embodiment. The difference between the second embodiment and the first embodiment is that unlocking information input module 28B of outer operating device 28 of the second embodiment can be a wireless receiving device for cooperating with an unlocking information transmitting device 80, such as a smart card using radio frequency identification (RFID). In this case, unlocking information input module 28B is an RFID transmitting/receiving device cooperating with the smart cared. Unlocking information transmitting device 80 can be placed to a location adjacent to outer operating device 28 of door lock 10. The unlocking information stored in unlocking information transmitting device 80 can be read to control unlocking of door lock 10.

Figure 5:
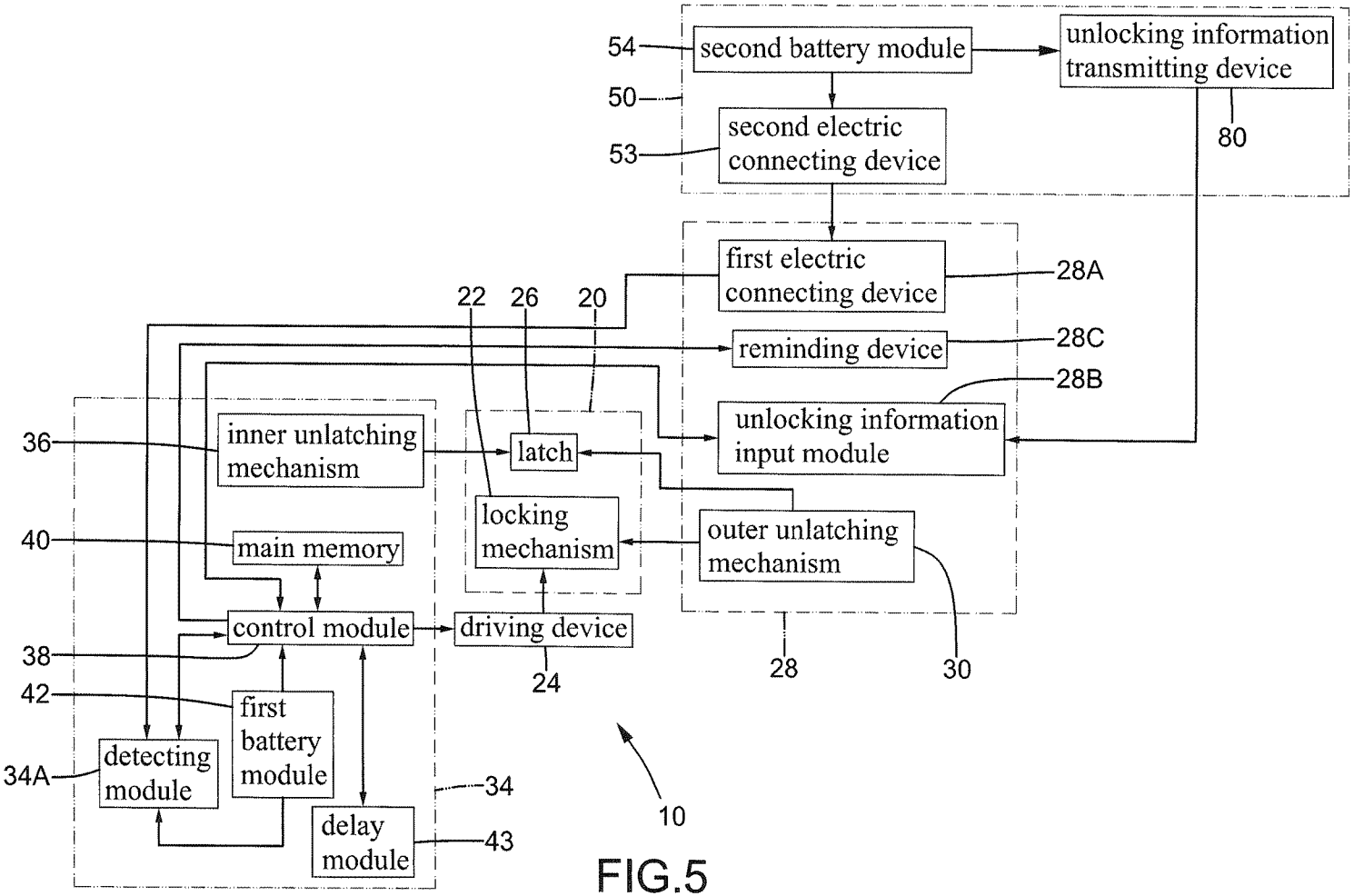
FIG. 5 is a diagrammatic block diagram illustrating a door lock using a power supply of a mobile device as the power source of a third embodiment according to the present invention.

FIG. 5 shows a third embodiment which is substantially the same as the first embodiment. The difference between the third embodiment and the first embodiment is that an unlocking information transmitting device 80 is mounted in mobile device 50. In an example of a smart phone, unlocking information transmitting device 80 can be a Bluetooth device built in the smart phone. Unlocking information input module 28B is a Bluetooth device. Thus, unlocking information input module 28B can use the Bluetooth to transmit unlocking information to door lock 10 to thereby control unlocking of door lock 10.

Figure 6:
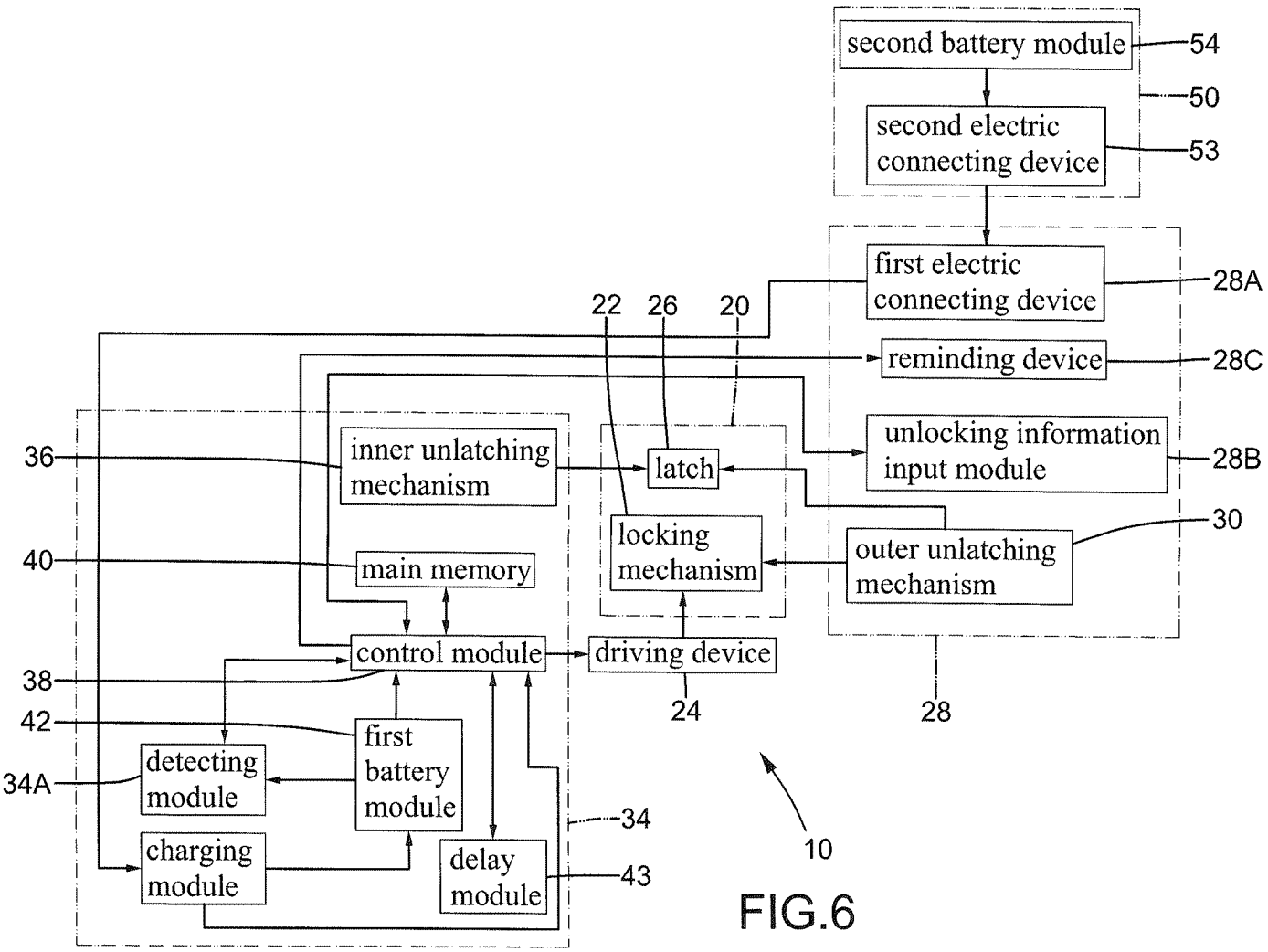
FIG. 6 is a diagrammatic block diagram illustrating a door lock using a power supply of a mobile device as the power source of a first embodiment according to the present invention.

FIG. 6 shows a fourth embodiment which is substantially the same as the first embodiment. The difference between the fourth embodiment and the first embodiment is that a charging module 34B is electrically connected between first battery module 42 and first electric connecting device 28A, and first battery module 42 uses rechargeable batteries.

When detecting module 34A detects that the remaining electricity of first battery module 42 is higher than the preset alarm value, inner operating device 34, outer operating device 28, and driving device 24 use the electricity of first battery module 42 to operate. In a case that detecting module 34A detects that the remaining electricity of first battery module 42 is lower than the preset alarm value and second electric connecting device 53 of mobile device 50 is not in electrical connection with first electric connecting device 28A, reminding device 28C generates the reminding signal, and inner operating device 34, outer operating device 28, and driving device 24 still use the electricity of first battery module 42 to operate. In another case that detecting module 34A detects that the remaining electricity of first battery module 42 is lower than the preset alarm value and second electric connecting device 53 of mobile device 50 is in electrical connection with first electric connecting device 28A, reminding device 28C does not generate the reminding signal, and charging module 34B uses the electricity of second battery module 54 to charge first battery module 42. Furthermore, inner operating device 34, outer operating device 28, and driving device 24 still use the electricity of first battery module 42 to operate.

Door lock 10 of each embodiment can use second battery module 54 of mobile device 50 as the power source for directly or indirectly supplying electricity required for operation of door lock 10 even though the electricity of first battery module 42 is lower than the preset alarm value or first battery module 42 is completely out of electricity.

Furthermore, door lock 10 of each embodiment can provide a reminding signal through reminding device 28C when the remaining electricity of first battery module 42 is lower than the preset alarm value. Thus, the user can be reminded of replacement of first battery module 42 to reduce the possibility of inability of operation of door lock 20 due to lack of electricity.

In the fourth embodiment, when the electricity of first battery module 42 is lower than the preset alarm value, second battery module 54 of mobile device 50 can be used to charge first battery module 42 through charging module 34B, effectively reducing the frequency of replacement of first battery module 42.

Now that the basic teachings of the present invention have been explained, many extensions and variations will be obvious to one having ordinary skill in the art.

For example, door lock 10 of the fourth embodiment can be set that when the remaining electricity of first battery module 42 is higher than the preset alarm value and second electric connecting device 53 of mobile device 50 is in electrical connection with first electric connecting device 28A of outer operating device 28, first battery module 42 can be charged by second battery module 54 of mobile device 50 through charging module 34B, thereby delaying dropping of the electricity of first battery module 42 to a value lower than the preset alarm value.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A door lock using a power supply of a mobile device as a power source, with the door lock configured to prevent opening of a door in a closed position, comprising:

a latch device adapted to be mounted to the door and operable to be set to a locked state or an unlocked state;

an inner operating device operatively connected to the latch device, with the inner operating device including a control module and a first battery module electrically connected to the control module and supplying electricity for operation of the door lock, with the inner operating device further including a detecting module electrically connected between the first battery module and the control module, with the detecting module detecting whether remaining electricity of the first battery module is higher or lower than a preset alarm value; and an outer operating device operatively connected to the latch device, with the outer operating device including a first electric connecting device electrically connected to the detecting module and an unlocking information input module electrically connected to the control module, with the first electric connecting device configured to be in electrical connection with a second electric connecting device of a mobile device having a screen, with the latch device set to the unlocked state, either of the inner operating device and the outer operating device is operable to actuate the latch device for opening the door, with the latch device set to the locked state, operation of the outer operating device for actuating the latch device for opening the door is prevented, wherein when the remaining electricity of the first battery module detected by the detecting module is higher than the preset alarm value, the first battery module supplies electricity to the door lock for operation, wherein when the remaining electricity of the first battery module detected by the detecting module is lower than the preset alarm value and the second electric connecting device of the mobile device is in electrical connection with the first electric connecting device, the second battery module of the mobile device supplies electricity to the door lock for operation.

2. The door lock as claimed in claim 1, with the outer operating device further including a reminding device electrically connected to the control module, wherein when the remaining electricity of the first battery module detected by the detecting module is higher than the preset alarm value, the reminding device is not activated by the control module, and wherein when the remaining electricity of the first battery module detected by the detecting module is lower than the preset alarm value, the reminding device is activated by the control module to generate a reminding signal indicating that the remaining electricity is lower than the preset alarm value.

3. The door lock as claimed in claim 2, wherein the reminding device is a buzzer or a lighting device.

4. A door lock using a power supply of a mobile device as a power source, with the door lock configured to prevent opening of a door in a closed position, comprising:

a latch device adapted to be mounted to the door and operable to be set to a locked state or an unlocked state;

an inner operating device operatively connected to the latch device, with the inner operating device including a control module and a first battery module electrically connected to the control module and supplying electricity for operation of the door lock, with the inner operating device further including a charging module electrically connected to the first battery module; and an outer operating device operatively connected to the latch device, with the outer operating device including a first electric connecting device electrically connected to the charging module and an unlocking information input module electrically connected to the control module, with the first electric connecting device configured to be in electrical connection with a second electric connecting device of a mobile device having a screen, with the latch device set to the unlocked state, either of the inner operating device and the outer operating device is operable to actuate the latch device for opening the door, with the latch device set to the locked state, operation of the outer operating device for actuating the latch device for opening the door is prevented, wherein when the second electric connecting device of the mobile device is not in electrical connection with the first electric connecting device, the second battery module does not charge the first battery module, and wherein when the second electric connecting device of the mobile device is in electrical connection with the first electric connecting device, the second battery module charges the first battery module through the charging module.

5. The door lock as claimed in claim 4, with the inner operating device further including a detecting module electrically connected between the first battery module and the control module, with the detecting module detecting whether remaining electricity of the first battery module is higher or lower than a preset alarm value, with the outer operating device further including a reminding device electrically connected to the control module, wherein when the remaining electricity of the first battery module detected by the detecting module is higher than the preset alarm value, the reminding device is not activated by the control module, and wherein when the remaining electricity of the first battery module detected by the detecting module is lower than the preset alarm value, the reminding device is activated by the control module to generate a reminding signal indicating that the remaining electricity is lower than the preset alarm value.

6. The door lock as claimed in claim 5, wherein the reminding device is a buzzer or a lighting device.

* * * * *